US006145774A

United States Patent [19]

Courtney, Jr. et al.

[11] Patent Number: 6,145,774

[45] Date of Patent: Nov. 14, 2000

[54] METHOD AND APPARATUS FOR MANUFACTURING TOROIDAL CORES

[75] Inventors: Robert Courtney, Jr.; Erik Scott Linnemeier; Chad Monroe Holloway, all of Fort Wayne, Ind.

[73] Assignee: Micropulse, Inc., Columbia City, Ind.

[21] Appl. No.: 09/400,058

[22] Filed: Sep. 21, 1999

[51] Int. Cl.[7] ..... B65H 81/02; H01F 41/08

[52] U.S. Cl. ..... 242/434.7; 29/605

[58] Field of Search ..... 242/434, 434.7, 242/434.9, 535.1, 535.2; 29/605

[56] References Cited

U.S. PATENT DOCUMENTS

| | | | |
|---|---|---|---|
| 1,455,188 | 5/1923 | Cox | 29/605 |
| 2,155,879 | 4/1939 | Washburn et al. | 242/535.1 |
| 2,191,393 | 2/1940 | Humphreys . | |
| 2,282,854 | 5/1942 | Driftmeyer | 242/434 |
| 3,039,710 | 6/1962 | Walter . | |
| 3,566,462 | 3/1971 | Moore | 29/605 |
| 3,743,212 | 7/1973 | Michaels . | |
| 4,381,600 | 5/1983 | Mas | 29/738 |

FOREIGN PATENT DOCUMENTS

| | | | |
|---|---|---|---|
| 883985 | 11/1981 | U.S.S.R. | 242/434.7 |

*Primary Examiner*—Donald P. Walsh
*Assistant Examiner*—Emmanuel M. Marcelo
*Attorney, Agent, or Firm*—Bakers & Daniels

[57] ABSTRACT

A method of winding a toroidal core through a bobbin aperture, including the steps of: providing a fixture having a cavity defined by first and second continuous arcuate walls, the first continuous arcuate wall having contiguous first and second surface portions of differing curvature; placing a bobbin having an aperture therethrough into the fixture such that the bobbin aperture opens into the cavity; feeding a ribbon of strip stock material having a leading edge and first and second sides into the fixture; feeding the leading edge of the ribbon through the bobbin aperture; sliding the ribbon along the second arcuate wall of the cavity; directing the leading edge of the ribbon toward and into sliding contact with the first surface portion of the first arcuate wall of the cavity; sliding the leading edge of the ribbon from the first surface portion of the first arcuate wall of the cavity to the second surface portion of the first arcuate wall of the cavity; and feeding the leading edge of the ribbon again through the bobbin aperture and placing the first side of the ribbon adjacent the second side of the ribbon within the cavity, whereby a coil comprised of a plurality of ribbon layers is formed through the bobbin aperture.

34 Claims, 5 Drawing Sheets

METHOD AND APPARATUS FOR MANUFACTURING TOROIDAL CORES

BACKGROUND OF THE INVENTION

1. Field of the Invention

The present invention relates to a method and apparatus for manufacturing toroidal cores comprising a plurality of layers of, for example, magnet iron, which extend through the aperture of another ring-like structure, such as an electrical coil of a transformer.

2. Description of the Related Art

It is generally known that electromagnetic induction devices such as transformers having a toroidally wound core encircling one or more wire-wound coils have high efficiency because they require less exciting current to establish a given flux as compared to other cores. Generally, in such devices, the magnet iron ribbon, from which the core is made, is threaded through one or more bobbins about which coil wire is wound.

FIGS. 1A through 1C depict an embodiment of a known transformer assembly which may be manufactured by the previous method and apparatus described immediately below, as well as by the inventive method and apparatus described further below. Transformer 20 comprises toroidal core 22 of ferrous strip stock material which links a pair of bobbins 24 and 26 respectively having center spool portions 28, 30 respectively disposed between flanges 32, 34 and 36, 38. Bobbins 22 and 24 may be identical and made from injection molded plastic. Spool portions 28, 30 are respectively provided with through-holes or apertures 40, 42. About each spool portion 28, 30, between its respective flanges, is wound a coil of wire (not shown) which may be covered with tape (as shown) or another suitable material. Referring to FIGS. 1A and 1B, the outer surface of the tape covering the wire about the spool portions is identified with reference numeral 44. The wire coils about spool portions 28 and 30 may have a different number of turns and be connected in series by means of connecting wires (not shown). Leading to and from the series-connected wire coils are a pair of electrical terminals 46; one terminal is connected to the start of one wire coil, the other terminal is connected to the end of the other wire coil. The bobbins may be completely wound with wire, the terminals attached, and the wires interconnected and taped prior to core 22 being wound through their apertures 40, 42 as discussed below.

Generally toroidal-shaped core, which extends through bobbin apertures 40, 42, encircles a portion of bobbins 24, 26, and may be made of a plurality of superimposed layers of magnet iron ribbon 48. Ribbon 48 is of uniform thickness and width, and has parallel opposite side edges 50, 52. Ribbon 48 may be provided in bulk to the manufacturing operation on spool 54 (FIG. 3). A continuous piece of ribbon 48 having leading end 56 is repeatedly wound through bobbin apertures 40, 42 in a spiral or flat coil shape, with the ribbon curved along its length. As shown in FIGS. 2A and 2B, leading end 56 has a leading edge 60, 60' which may be straight or beveled. The leading edge may also be arcuate (not shown). Beveled and curved leading edge configurations serve to help thread leading end 56 through bobbin apertures 40, 42. Once core 22 has been formed with the desired number of turns or layers of ribbon (e.g., 26 layers of ribbon 48), trailing end 58 is formed in the ribbon which comprises core 22. Trailing end 58 of ribbon 48 of each core 22 has a trailing edge. The trailing edge of a first core 22 is formed during a shearing process which simultaneously forms leading edge 60 of the next-to-be-manufactured core 22. Thus, the edges of the leading and trailing ends 56, 58 of a core 22 have complementary shapes.

Referring to FIGS. 1A, 1B and 3, it can be seen that in core 22, opposite first and second sides 62, 64 of ribbon 48 lay adjacent one another. Referring now in particular to FIGS. 1A and 1C, trailing end 58 is attached to the body of core 22 by means of being welded at 66 to the adjacent layer of ribbon 48. Weld 66 should not extend through the adjacent layer underlying the trailing end, and so plasma welding is preferred. Alternatively, however, trailing end 58 may be attached to core 22 by other means, such as being taped or clamped thereto. It should be noted that leading end 56 may remain free and unattached. As will be discussed below, in accordance with the previous method and apparatus for manufacture of the core, leading end 56 is urged into the inward most point of the spiral shape formed by ribbon 48 due to a plastic deformation of the ribbon itself.

Referring now to FIG. 3, there is shown previous apparatus 68, until now probably the most effective means for automated manufacture of devices such as transformers 20 which comprise toroidally-wound cores. Apparatus 68 comprises fixture 70 having first and second parts 72, 74. Within first fixture part 72 is passage 76 through which ribbon 48 is forced by means of pinch roller set 78. Ribbon 48 is pushed into fixture 70, and core 22 is formed therein as described hereinbelow. Ribbon 48 may be lubricated before entering fixture 70, or even pinch roller set 78, to ease its movement through passage 76, which is provided with sharp bend 80 therein. Lubrication of ribbon 48 may be especially beneficial where leading edge 60 has a bur thereon. As shown, passage bend 80 is approximately 90°, although other bend angles may be used instead. The purpose of bend 80 in passage 76 is to plastically deform ribbon 48 such that it takes on a permanent set which tends to urge the ribbon into a spiral or flat coil shape, with leading end 56 curving or spiraling inward. The resultant shape of the ribbon is a spiral or flat coil wherein the ribbon lies between two parallel planes which are perpendicular to ribbon sides 62, 64, and along which ribbon side edges 50, 52 lie. In conjunction with the structure of fixture 70 as further described hereinbelow, the plastic deformation ribbon 48 undergoes as it passes through bend 80 allows leading end 56 to be more easily directed initially through bobbin apertures 40, 42, and ribbon 48 itself to be more readily wound therethrough. Apparatus 68 is also provided with means such as a shear (not shown) for providing trailing end 58 in ribbon 48; this means may be located in fixture part 72 such that it severs ribbon 48 within passage 76.

Referring to FIG. 3, first and second fixture parts 72, 74 move relative to one another, with first fixture part 72 fixed and second fixture part 74 allowed to move in the directions of arrow 82. Spring 84 urges fixture part 74 into a first position in which expandible cavity 86 defined by and between fixture parts 72, 74 is at a first, smallest size. Fixture parts 72, 74 are each provided with respective cavity-forming arcuate walls 88, 90 of constant and identical radius of curvature, e.g., 0.800 inch.

Cavity 86 expands from its first, smallest size to a second, larger size by virtue of the movement of second fixture part 74 against the force of spring 84 as ribbon 48 fills the cavity and pushes the fixture parts away from each other, thereby expanding the size of cavity 86. Under this previous method, as increased amounts of ribbon 48 are fed into cavity 86, second fixture part 74 is forced away from first cavity part 72 in an uncontrolled manner.

First cavity part 72 is provided with recesses 92, 94 which partially define spaces 96, 98 in cavity 86. Bobbins 24, 26, which may be already wound with wire and connected thereby, are respectively disposed in spaces 96, 98. Passageway 76 extends into space 98 of cavity 86, directed towards aperture 42 of bobbin 26 and, as ribbon 48 is fed into cavity 86, it is threaded through the aperture of bobbin 26 and slidingly contacts arcuate wall 90 of second fixture part 74. During initial formation of core 22, ribbon 48 slidingly contacts arcuate wall 90 and, by means of its plastic deformation, which tends to spirally curl leading end 56 inward, and its contact with wall 90, leading end 56 is directed through aperture 40 of bobbin 24. The amount of plastic deformation of ribbon 48 induced by its being forced through corner 80 of passageway 76 may vary somewhat with strip stock variations and with the distance from the radial center of spool 54 at which the stock was stored on the spool.

Due to such variations in the amount of plastic deformation, and particularly as the number of turns or layers of ribbon 48 in core 22 increases, the plastic deformation of the ribbon may cause its leading edge 60 to come too close to the inward edge of the opening of bobbin aperture 40 or 42; consequently, leading end 56 may not always be fed through the bobbin aperture, instead sliding along flange 34 or 36 toward the center of cavity 86. When this occurs, the process is halted and the transformer being manufactured in fixture 70 is scrapped, compromising the consistency of product yield level from apparatus 68. A means of directing the ribbon through apertures 40, 42 of bobbins 24, 26 without plastic deformation thereof is therefore desirable, and would likely result in higher, and consistent, product yield levels.

Referring still to FIG. 3, after leading end 56 extends through bobbin 24, it comes into sliding contact with arcuate wall 88 of first fixture part 72. By means of the plastic deformation of ribbon 48 and its sliding contact with arcuate wall 88, leading end 56 is directed into aperture 42 of bobbin 26 again, wherein ribbon first and second ribbon sides 62, 64 interface and contact each other. Ribbon 48 is continually fed into fixture 70 and, as leading end 56 makes subsequent passes through apertures 40, 42 of bobbins 24 and 26, the number of ribbon layers in core 22 increases. As the number of ribbon layers in core 22 increases, second fixture part 74 is forced away from first fixture part 72, expanding cavity 86 against the force of spring 84. The expansion rate of cavity 86, although dependent on the amount of ribbon 48 in cavity 86, is uncontrolled. Consequently, the number of turns, or layers of ribbon 48, in a core 22 may undesirably vary. That is, although the amount of ribbon which has been fed into fixture 70 may be controlled, because the expansion of cavity 86 is dependent on how consistently the diametrical size of core 22 can be formed therein, the number of layers will vary: Cores having larger diameters will have fewer turns or layers as they are removed from the fixture, whereas cores having smaller diameters will have more turns. Notably, frictional resistance between adjacent ribbon sides 62, 64, or between ribbon side 64 and arcuate wall 88 of first cavity part 72, may affect the expansion rate of cavity 86. A means of better controlling the expansion of the chamber is desirable to produce cores of a consistent number of turns, thus improving the consistency of product quality.

After the desired amount of ribbon 48 has been fed into fixture 70, ribbon 48 is severed to provide trailing end 58 of the just-formed core 22 and leading end 56 of the next core 22 to be manufactured. The bobbin and core assembly is then moved to a subsequent welding or attaching station (not shown) where trailing end 58 may be then attached to the remainder of core 22 by, for example, providing weld 66 as described above. Further, a subsequent blocking station (not shown) may also be provided for then providing shoulders 100, 102, 104, 106 on core 22, as shown in FIG. 1A.

As indicated above, previous apparatus 68, although probably the most effective means known for automated manufacture of devices such as transformer 20 which comprise a toroidally-wound core, it is desirable to provide means for providing comparably higher and more consistent levels of product yield and quality.

SUMMARY OF THE INVENTION

The present invention provides an improved method and apparatus for quickly and efficiently winding a toroidal core through one or more annular bobbins. The inventive method and apparatus are suitable for large scale manufacturing operations.

The present invention provides a method of winding a toroidal core through a bobbin aperture which includes the steps of: providing a fixture having a cavity defined by first and second continuous arcuate walls, the first continuous arcuate wall having contiguous first and second surface portions of differing curvature; placing a bobbin having an aperture therethrough into the fixture such that the bobbin aperture opens into the cavity; feeding a ribbon of strip stock material having a leading edge and first and second sides into the fixture; feeding the leading edge of the ribbon through the bobbin aperture; sliding the ribbon along the second arcuate wall of the cavity; directing the leading edge of the ribbon toward and into sliding contact with the first surface portion of the first arcuate wall of the cavity; sliding the leading edge of the ribbon from the first surface portion of the first arcuate wall of the cavity to the second surface portion of the first arcuate wall of the cavity; and feeding the leading edge of the ribbon again through the bobbin aperture and placing the first side of the ribbon adjacent the second side of the ribbon within the cavity, whereby a coil comprised of a plurality of ribbon layers is formed through the bobbin aperture.

The present invention also provides a method of manufacturing a toroidally-wound first ring inside a second ring which includes the steps of: providing opposed first and second walls, the first wall having a continuous arcing surface comprising contiguous first and second surface portions of differing curvature, the second wall having a continuously arcing surface, the first and second walls defining a cavity, and a second ring disposed between the first and second walls, a portion of the second ring within the cavity; passing the leading edge of a ribbon of strip stock material through the second ring; sliding the ribbon along the arcuate surface of the second wall; bringing the leading edge of the ribbon into sliding contact with the first surface portion of the first wall; sliding the ribbon along the second surface portion of the first wall; and passing the leading edge of the ribbon through the second ring an additional plurality of times to form a first ring having a plurality of ribbon layers between the first and second walls.

The present invention also provides a method of manufacturing a toroidally-wound first ring inside a second ring which includes the steps of: A method of manufacturing a toroidally-wound first ring inside a second ring, comprising the steps of: providing oppositely facing first and second arcuate wall surfaces; passing the leading edge of a ribbon of strip stock material through the second ring; sliding the ribbon along the second arcuate wall surface; sliding the ribbon along the first arcuate wall surface; passing the leading edge of the ribbon through the second ring an additional plurality of times to form a first ring having a plurality of ribbon layers between the first and second arcuate wall surfaces; and controllably separating the first and second arcuate wall surfaces.

The present invention also provides an apparatus for manufacturing a toroidal core which includes a fixture having a passageway through which a ribbon of strip stock material extends, the fixture having separable first and second parts. The first and second fixture parts respectively have first and second arcuate walls, the first and second arcuate walls at least partially defining an expandible cavity. The passageway is in communication with the cavity, and the cavity includes a space in which a bobbin element having a through-hole is disposed, the passageway opening into the space. The passageway opening is substantially aligned with the bobbin element through-hole, whereby the ribbon extends from the passageway, through the bobbin element through-hole, and into the cavity. The apparatus further includes means for feeding the ribbon through the passageway and within the cavity; and means for elastically curving the ribbon into a spiral shape inside the cavity, whereby the ribbon is spirally wound through the bobbin element through-hole. At least one of the first and second arcuate cavity walls is controllably moved between a first position in which the cavity has a first size and a second position in which the cavity has a second size larger than the first cavity size.

BRIEF DESCRIPTION OF THE DRAWINGS

The above-mentioned and other features and advantages of this invention, and the manner of attaining them, will become more apparent and the invention itself will be better understood by reference to the following description of the embodiments of the invention taken in conjunction with the accompanying drawings, wherein.

DETAILED DESCRIPTION OF THE INVENTION

Figure 3:
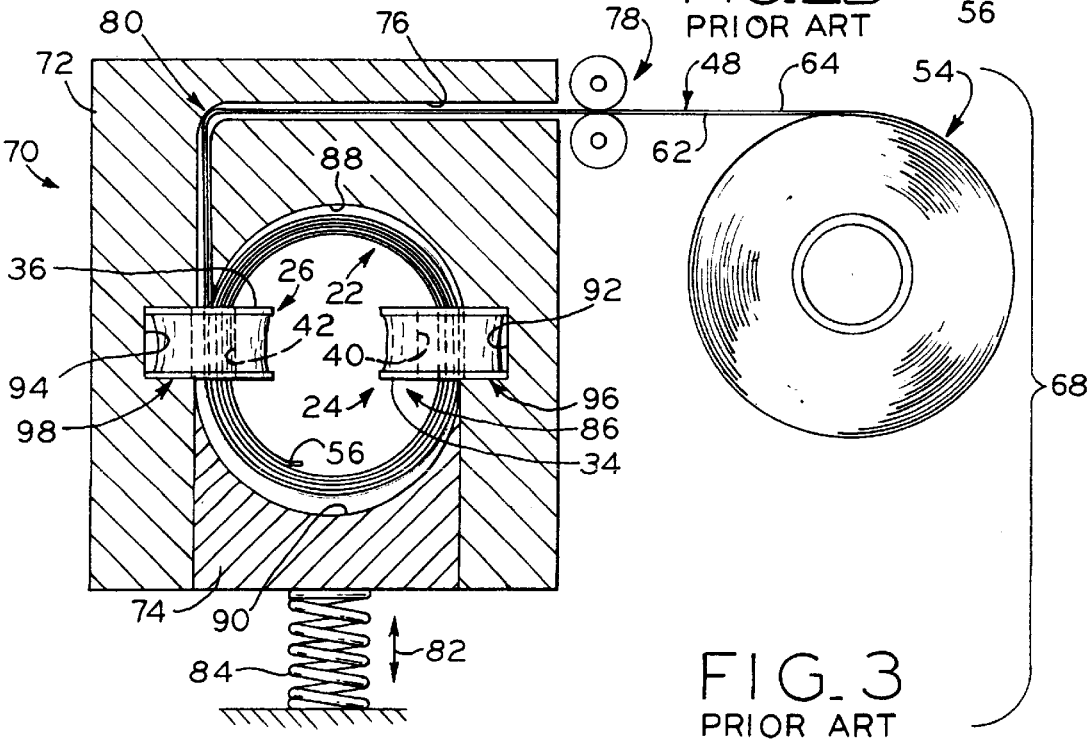
FIG 3 PRIOR ART
FIG. 3 is a sectional side view of a portion of a previous apparatus for manufacturing a toroidal core such as that depicted in FIG. 1.
Figure 4:
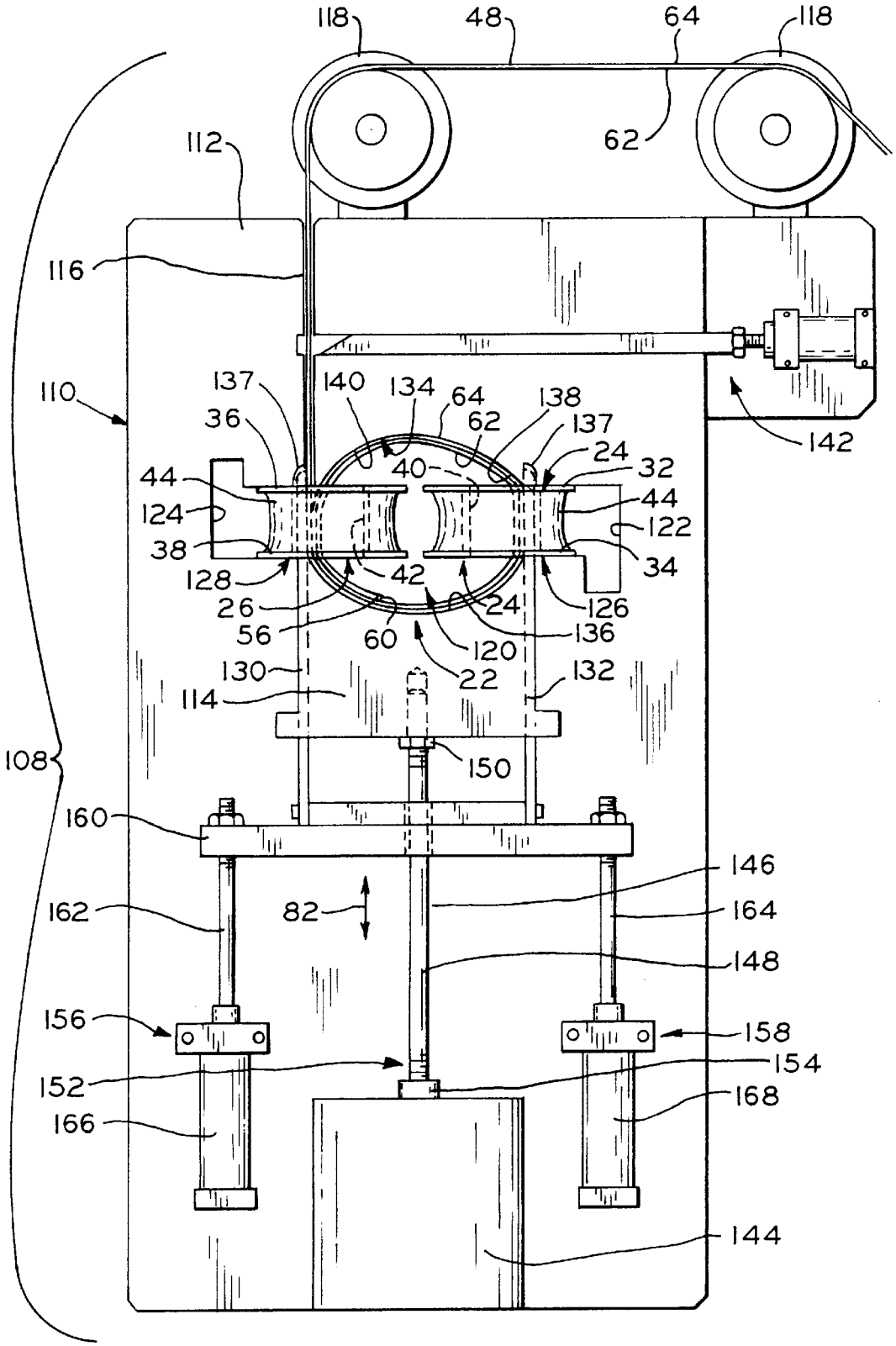
FIG. 4 is a side view of an apparatus for manufacturing a toroidal core such as that depicted in FIG. 1, according to one embodiment of the present invention.

FIG. 4 illustrates apparatus 108 according to one embodiment of the present invention, which used to manufacture devices such as transformer 20. Apparatus 108 comprises fixture 110, which includes separable first fixture part 112 and second fixture part 114. The upper portion of first fixture part 112 is provided with passageway 116 through which ribbon 48 passes. Ribbon 48 travels from spool 54 (as shown in FIG. 3) over feed rollers 118, through passageway 116 and into cavity 120, which is defined by opposed first and second arcuate walls 134, 136 respectively formed on first and second fixture parts 112, 114. First fixture part 112 is provided with recesses 122, 124 which partially define spaces 126, 128 in cavity 120. Bobbins 24, 26 are respectively disposed in spaces 126, 128 and are situated such that their apertures or through-holes 40, 42 open into cavity 120.

Second fixture part 114 is provided with elongate finger members 130, 132, which are slidably engaged with part 114 and are located at, and substantially tangentially oriented along second wall surface 136 at opposite first and second ends 170, 172 thereof. Finger members 130, 132 slidably extend upwards through spaces 126, 128, their terminal ends seating in recesses 137 provided in first fixture part 112 such that, with bobbins 24, 26 in place, the fingers are selectively extended into, and retracted from, bobbin apertures 40, 42. As shown in FIG. 4, fingers 130, 132 are disposed along the outward sides of apertures 40, 42, and provide a surface along which ribbon 48 is slidably engaged. As shown, side 64 of ribbon 48 slides along finger 130 such that leading end 56 is guided therealong and through aperture 42 of bobbin 26. The leading end of ribbon 48 is then brought into sliding contact with second arcuate wall 136 of cavity 120. Ribbon 48 follows the contour of second arcuate wall 136, its curvature directing leading end 56 of ribbon 48 into sliding engagement with second elongated finger member 132, which is selectively extended through aperture 40 of bobbin 24. Leading end 56 is guided by finger member 132 upwards and into sliding contact with first surface portion 138 of first arcuate wall 134.

Figure 8:
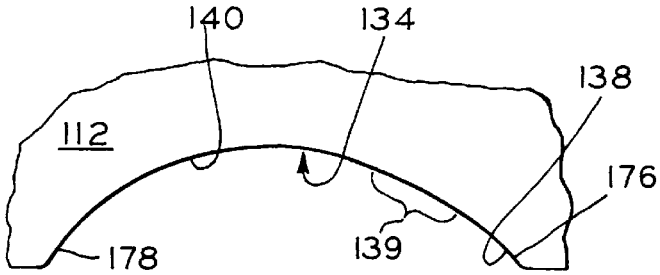
FIG. 8 is an even further enlarged, fragmentary side view of the arcuate upper cavity wall surface of FIG. 7, showing the differing radii of curvature of between contiguous surface portions thereof.
Figure 9:
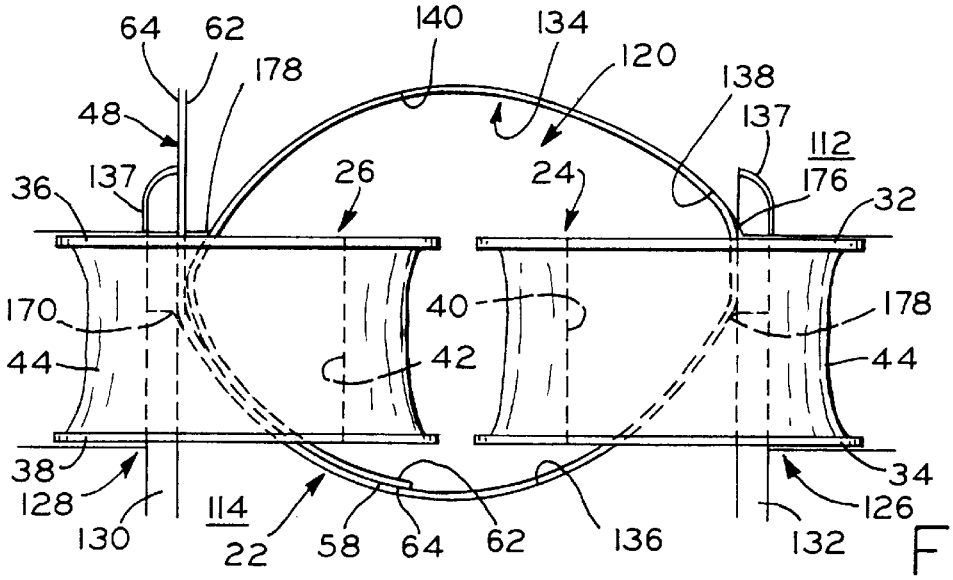
FIG. 9 is an enlarged view of the expanding cavity of the apparatus of FIG. 4 as a core of ribbon layers begins to form.

Leading edge 60 of ribbon 48 slides along first surface portion 138, the entirety of which is located at first end 176 of first arcuate wall 134, and over transition 139 (FIG. 8) onto contiguous second surface portion 140. The radius of curvature of first surface portion 138 is slightly smaller than that of second surface portion 140. For example, the radius of curvature of first surface portion 138 of first arcuate wall 134 may be 0.625 inch, whereas the radius of curvature of second surface portion 140 of first wall 134 may be 0.800 inch. First surface portion 138 catches leading end 56 of ribbon 48 as it initially comes into contact with first arcuate wall 134 of cavity 120 and then directs the leading end of the ribbon towards second surface portion 140, which further imparts a spiral shape to the ribbon. It can be readily understood that during initial formation of ribbon 48 inside cavity 120, the concave shapes of curvature of first and second arcuate walls 134, 136 impart a spiral shape to ribbon 48, as does the surface of inwardly facing side 62 of the ribbon as subsequent layers of ribbon are established. It has been found, however, that providing first surface portion 138 of first arcuate wall 134 with a smaller radius of curvature, vis-a-vis that of contiguous second surface portion 140, reliably helps to guide ribbon leading end 56 into a spiral shape after it has been threaded through bobbin aperture 40.

Leading end 56 of ribbon 48 is more easily directed towards apertures 40, 42 of bobbins 24, 26 as the ribbon is initially threaded through the apertures. Subsequent passes of the leading end are directed through apertures 40, 42 by its leading edge 60 being in sliding contact with radially inwardly facing side surface 62 of the ribbon within cavity 120. Second surface portion 140 of first arcuate wall 134 is circumferentially much longer than first surface portion 138, and extends nearly the entire length of first arcuate wall 134, from transition 139 to end 178 of first arcuate wall 134. The radii of curvature of second arcuate wall 136 and second portion 140 of first arcuate wall 134 are substantially identical, e.g., both are 0.800 inch, in order to better provide uniform winding of core 22 through bobbins 24, 26.

Further, it is to be noted that because ribbon 48 is elastically, rather than plastically deformed, there is no tendency for the leading end thereof to strike flanges 34 or 36 of bobbins 24, 26 and inadvertently direct the leading end therealong and toward the radial center of cavity 120. Rather, leading edge 60 is urged into contact with side 62 of the ribbon (FIG. 4), away from the inward edges of the openings of bobbin apertures 40 and 42, while core 22 is being wound. Apparatus 108 is also provided with ribbon severing means, such as spring loaded stripper or shear 142 for cutting the ribbon of core 22 to proper length within passage 116. Shear 142 also provides the desired shape of leading edge 60.

Figure 5:
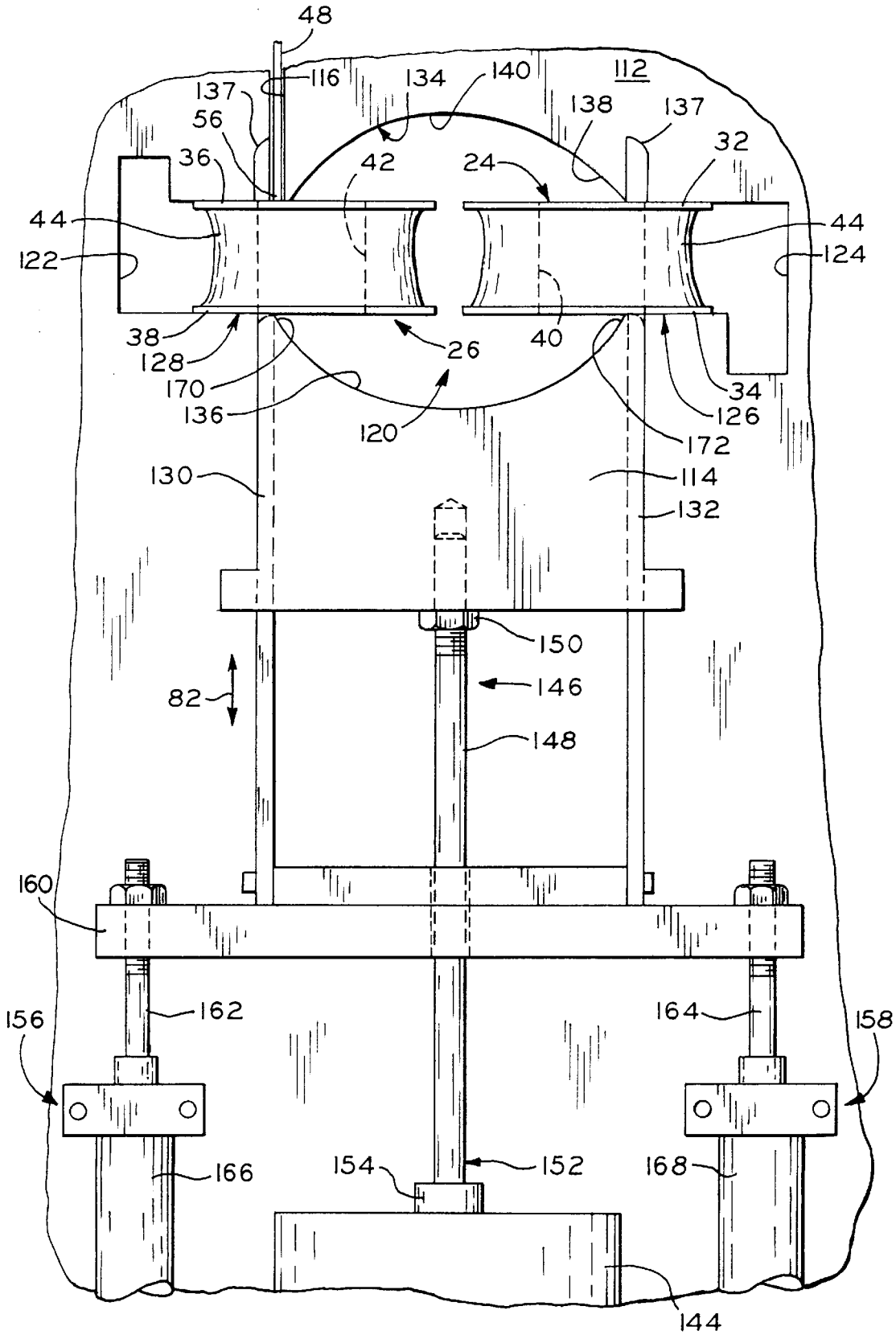
FIG. 5 is an enlarged, fragmentary side view of the expanding cavity of the apparatus of FIG. 4, shown in an open position to receive a new pair of bobbins or release a completed coil.
Figure 6:
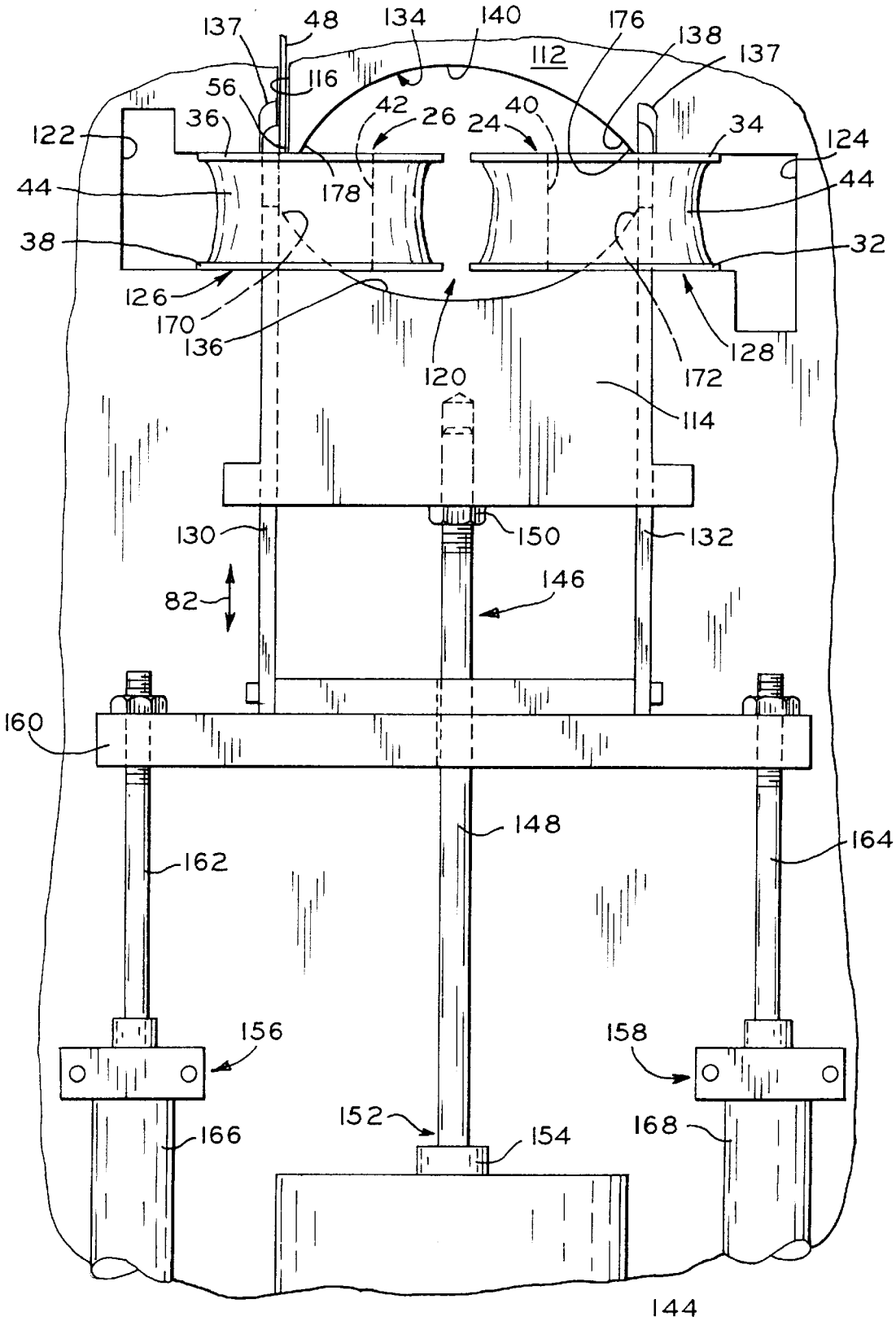
FIG. 6 is an enlarged, fragmentary side view of the expanding cavity of the apparatus of FIG. 4, shown in a first closed position to begin winding a core.

As shown in FIGS. 4, 5, and 6, first fixture part 112 is fixed. Second fixture part 114 moves relative to part 112 in the directions of arrow 82. Electric servomotor 144, and ball screw assembly 146, comprising an assemblage which is well known in the art, controllably drive second fixture part 114 in the directions of arrow 82. End 150 of ball screw 148 is secured to a lower end of second fixture part 114; portion 152 of ball screw 148 is threadedly engaged in rotating collar 154 of servomotor 144. Servomotor 144, which may be controlled by an operator or automatically, rotatably drives collar 154, thereby moving screw 148 up and down through the collar and motor, and controlling the movement of second fixture part 114 relative to first fixture part 112. Thus, the size of chamber 120 is controllably expanded or retracted.

Referring to FIGS. 5 and 6, pneumatic actuators 156, 158, which are of a type well known in the art, drive steel common plate 160, to which finger members 130, 132 are attached, in the directions of arrow 82, thereby selectively extending and retracting the fingers into and from apertures 40, 42 of bobbins 24, 26. Finger members 130, 132 are fully extended through the bobbins to begin winding core 22, and are fully retracted therefrom when core winding is 90% complete. Pneumatic actuators 156, 158 respectively comprise extending rods 162, 164, which are fixed to opposite ends of common plate 160. Rods 162, 164 extend from, or retract into pneumatic actuator cylinders 166, 168, which are fixed relative to first fixture part 112. Two pneumatic actuators are provided to provide equal force at both ends of common plate 160, thereby providing better control over the movement of finger members 130, 132, although it is envisioned that a single pneumatic actuator may satisfactorily drive plate 160. Further, it is envisioned that means other than a pneumatic actuator may be effectively used to extend and retract the fingers as described above.

In performing the process of the present invention, apparatus 108 is operated as follows: Cavity 120 is expanded to its largest size, shown in FIG. 5, with fingers retracted, and bobbins 24 and 26 are respectively placed in spaces 126, 128. Cavity 120 is then reduced to its smallest size, shown in FIG. 6. Finger members 130, 132 are then extended through the bobbins.

Ribbon 48 is directed, at controlled rate, through passageway 116, its leading end 56, formed by shear 142, moving towards and into aperture 42 of bobbin 26. Ribbon 48 extends through aperture 42, slidably contacts the inside surface of first finger member 130, and is guided therealong towards first end 170 of second arcuate wall 136. Leading end 56 then comes into contact with second arcuate wall 136 and slides therealong, becoming elastically deformed by the curvature of the wall towards the wall's second end 172. The ribbon is, in part, upwardly directed towards aperture 40 of bobbin 24, but as its leading end 56 comes into sliding contact with the inside surface of second finger member 132, it is positively guided upwards and through aperture 40.

Figure 7:
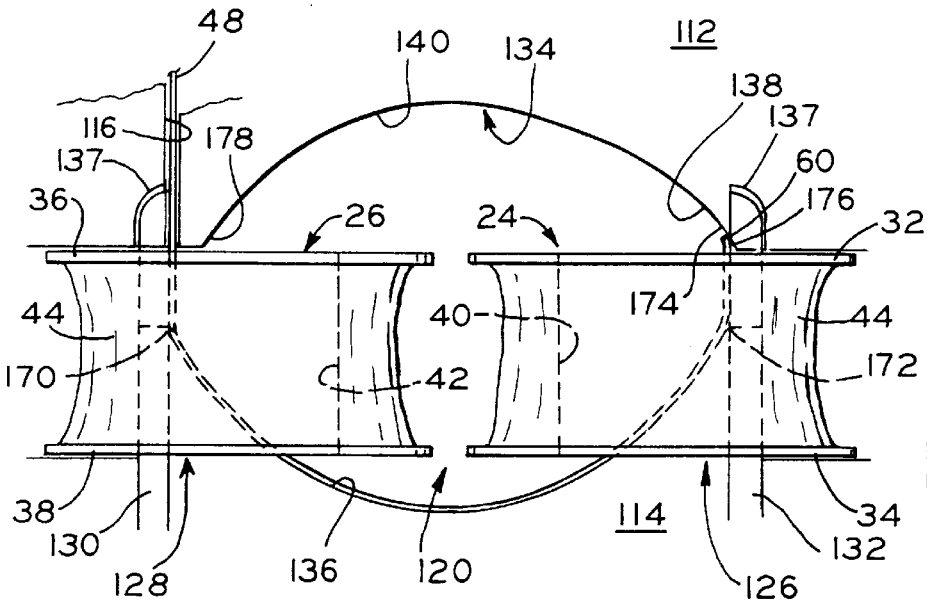
FIG. 7 is a further enlarged, fragmentary side view of the expanding cavity of the apparatus of FIG. 4, showing the point of contact between the leading edge of the material strip stock ribbon and a first surface portion of the arcuate upper cavity wall.

Referring now to FIG. 7, second finger member 132 directs leading end 56 of ribbon 48 into contact with first surface portion 138 of first arcuate wall 134, such that leading edge 60 abuts contact point 174 on first surface portion 138. Leading edge 60 slides along first surface portion towards contiguous second surface portion 140 of first arcuate wall 134. The leading edge of the ribbon then slides off of first arcuate wall end 178, and side 64 of the ribbon is brought into contact with side 62 of the ribbon. As more ribbon is fed into cavity 120 through passageway 116, the adjacent layers of core 22 thus increase, leading end 56 spiraling inwards towards the center of the cavity.

Once core 22 is 90% wound, based on the total amount of ribbon fed into the fixture, pneumatic actuators 156, 158 are retracted to retract finger members 130, 132 from bobbin apertures 40, 42. At this point, the winding process enters a completion phase wherein ball screw assembly 146, controllably driven by servomotor 144, retracts second fixture part 114 such that cavity 120 assumes an expanded second size which is 90% of its largest, open size in which the bobbins are loaded into the cavity and the wound transformer is removed therefrom. Alternatively, servomotor may be actuated throughout the time during which ribbon 48 is fed into cavity 120, to increasingly expand the cavity from its first size to its second size with increasing numbers of ribbon layers therein.

Figure 1A:
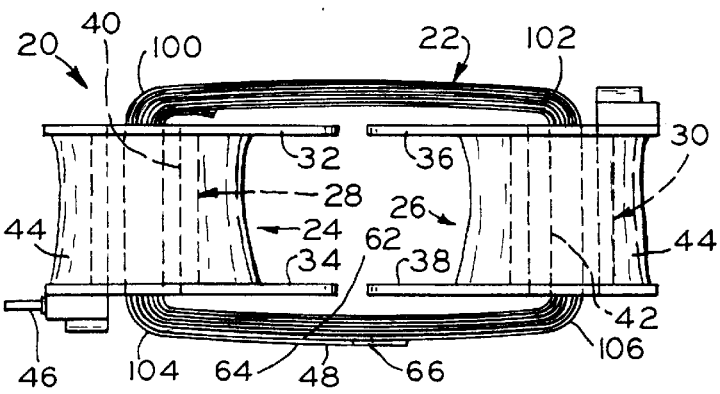
FIG 1A PRIOR ART
FIG. 1A is a side view of a prior art transformer which may be manufactured in accordance with the apparatus and method of the present invention.
Figure 1B:
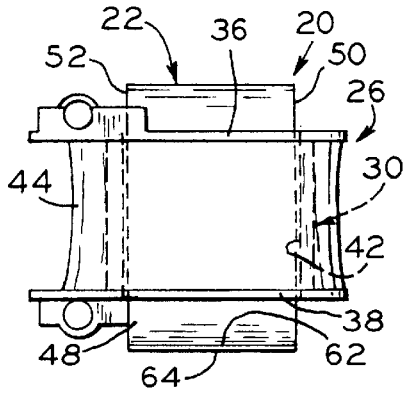
FIG 1B PRIOR ART
FIG. 1B is an end view of the transformer of FIG. 1A.
Figure 1C:
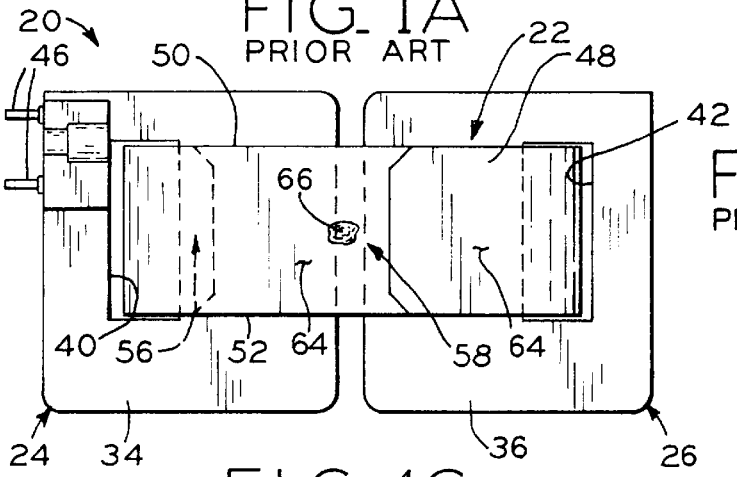
FIG 1C PRIOR ART
FIG. 1C is a bottom view of the transformer of FIG. 1A.
Figure 2A:
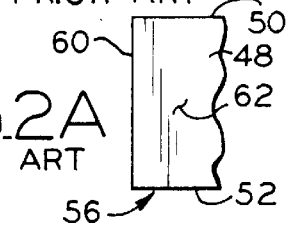
FIG 2A PRIOR ART
FIG. 2A is a fragmentary view of the leading end of the material strip stock ribbon which comprises the transformer of FIG. 1, showing one configuration of its leading edge.
Figure 2B:
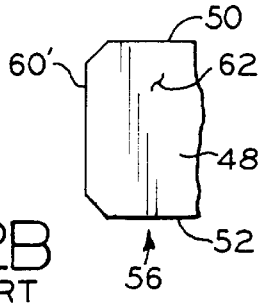
FIG 2B PRIOR ART
FIG. 2B is a fragmentary view of the leading end of the material strip stock ribbon which comprises the transformer of FIG. 1, showing an alternative configuration of its leading edge.

Once the desired amount of ribbon 48 has been fed into fixture 110, providing the correct number of ribbon layers or turns in core 22, second fixture part 114 is lowered the remaining 10% to expand cavity 120 from its second size to its largest, open size, and ribbon 48 is severed by shear 142. After transformer 20 is removed from the fixture, trailing end 58 may be attached to the remainder of core 22 at a subsequent attaching station (not shown). As mentioned above, trailing end 58 may be fixed to core 22 by means of plasma weld 66 (FIG. 1C), and the core blocked to provide shoulders 100, 102, 104 and 106 (FIG. 1A).

While this invention has been described as having an exemplary design or process, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of winding a toroidal core through a bobbin aperture, comprising the steps of:

providing a fixture having a cavity defined by first and second continuous arcuate walls, the first continuous arcuate wall having contiguous first and second surface portions of differing curvature;

placing a bobbin having an aperture therethrough into the fixture such that the bobbin aperture opens into the cavity;

feeding a ribbon of strip stock material having a leading edge and first and second sides into the fixture;

feeding the leading edge of the ribbon through the bobbin aperture;

sliding the ribbon along the second arcuate wall of the cavity;

directing the leading edge of the ribbon toward and into sliding contact with the first surface portion of the first arcuate wall of the cavity;

sliding the leading edge of the ribbon from the first surface portion of the first arcuate wall of the cavity to the second surface portion of the first arcuate wall of the cavity; and feeding the leading edge of the ribbon again through the bobbin aperture and placing the first side of the ribbon adjacent the second side of the ribbon within the cavity, whereby a coil comprised of a plurality of ribbon layers is formed through the bobbin aperture.

2. The method of claim 1, further comprising the step of forming a trailing edge in the ribbon.

3. The method of claim 1, further comprising the step of expanding the cavity with increasing numbers of ribbon layers within the cavity.

4. The method of claim 3, wherein said step of expanding the cavity comprises controllably retracting the second arcuate wall of the cavity from the first arcuate wall of the cavity.

5. The method of claim 1, wherein the second arcuate wall of the cavity has first and second ends and said providing step further comprises providing an elongate finger member adjacent and substantially tangential to the first end of the second arcuate wall of the cavity, and further comprising the step of inserting the finger member into the aperture of the bobbin.

6. The method of claim 5, wherein said step of feeding the leading edge of the ribbon through the bobbin aperture includes sliding the leading edge along the finger member.

7. The method of claim 6, wherein said providing step further comprises providing a second elongate finger member adjacent and substantially tangential to the second end of the second arcuate wall of the cavity, and further comprising the steps of:

placing a second bobbin having an aperture into the fixture such that the second bobbin aperture opens into the cavity;

inserting the second finger member into the aperture of the second bobbin;

feeding the leading edge of the ribbon through the second bobbin aperture and sliding the leading edge of the ribbon along the second finger member.

8. A method of manufacturing a toroidally-wound first ring inside a second ring, comprising the steps of:

providing opposed first and second walls, the first wall having a continuous arcing surface comprising contiguous first and second surface portions of differing curvature, the second wall having a continuously arcing surface, the first and second walls defining a cavity, and a second ring disposed between the first and second walls, a portion of the second ring within the cavity;

passing the leading edge of a ribbon of strip stock material through the second ring;

sliding the ribbon along the arcuate surface of the second wall;

bringing the leading edge of the ribbon into sliding contact with the first surface portion of the first wall;

sliding the ribbon along the second surface portion of the first wall; and passing the leading edge of the ribbon through the second ring an additional plurality of times to form a first ring having a plurality of ribbon layers between the first and second walls.

9. The method of claim 8, wherein the first surface portion of the first wall has a first radius of curvature and the second surface portion of the first wall has a second radius of curvature, the second radius of curvature larger than the first radius of curvature.

10. The method of claim 9, wherein the arcuate surface of the second wall has a radius of curvature substantially identical to the second radius of curvature.

11. The method of claim 8, further comprising the step of forming a trailing edge in the ribbon.

12. The method of claim 8, further comprising the step of increasingly separating the first and second walls as the number of ribbon layers therebetween increases.

13. The method of claim 12, wherein said step of increasingly separating the first and second walls comprises the step of controllably moving the second wall away from the first wall.

14. The method of claim 13, wherein said step of controllably moving the second wall away from the first wall comprises actuating an electric motor coupled to the second wall.

15. A method of manufacturing a toroidally-wound first ring inside a second ring, comprising the steps of:

providing oppositely facing first and second arcuate wall surfaces;

passing the leading edge of a ribbon of strip stock material through the second ring;

sliding the ribbon along the second arcuate wall surface;

sliding the ribbon along the first arcuate wall surface;

passing the leading edge of the ribbon through the second ring an additional plurality of times to form a first ring having a plurality of ribbon layers between the first and second arcuate wall surfaces; and controllably separating the first and second arcuate wall surfaces.

16. The method of claim 15, wherein said step of controllably separating the first and second arcuate wall surfaces comprises the step of drawing the second arcuate wall surface away from the first arcuate wall surface.

17. The method of claim 16, wherein said drawing step comprises the step of actuating an electric motor coupled to the second arcuate wall surface.

18. The method of claim 17, wherein the electric motor is a servomotor, the second arcuate wall surface drawn away from the first arcuate wall surface as the servomotor rotates in one direction.

19. An apparatus for manufacturing a toroidal core comprising:

a fixture having a passageway through which a ribbon of strip stock material extends, said future having separable first and second parts, said first and second fixture parts respectively having first and second arcuate walls, said first and second arcuate walls at least partially defining an expandible cavity, said passageway in communication with said cavity, said cavity including a space in which a bobbin element having a through-hole is disposed, said passageway opening into said space, said passageway opening substantially aligned with the bobbin element through-hole, whereby the ribbon extends from said passageway, through the bobbin element through-hole, and into said cavity;

means for feeding the ribbon through said passageway and within said cavity; and means for elastically curving the ribbon into a spiral shape inside said cavity, whereby the ribbon is spirally wound through the bobbin element through-hole; and wherein at least one of said first and second arcuate cavity walls is controllably moved between a first position in which said cavity has a first size and a second position in which said cavity has a second size larger than said first cavity size.

20. The apparatus of claim 19, wherein said means for elastically curving the ribbon into a spiral shape inside the cavity comprises the shapes of said first and second arcuate walls.

21. The apparatus of claim 20, wherein said means for elastically curving the ribbon into a spiral shape inside said cavity comprises providing one of said first and second arcuate walls with curved first and second contiguous surface portions having substantially different curvatures.

22. The apparatus of claim 21, wherein said first arcuate wall has first and second ends, said first and second contiguous surface portions adjoining at a location on said first arcuate wall proximal one of its said first and second ends.

23. The apparatus of claim 22, wherein the entirety of said first surface portion of said first arcuate wall is located proximal one of its said first and second ends.

24. The apparatus of claim 21, wherein said curved first and second surface portions are respectively at least partially defined by different first and second radii of curvature, respectively, said first radius of curvature smaller than said second radius of curvature.

25. The apparatus of claim 19, wherein said second arcuate wall has first and second ends, and further comprising an elongate finger member disposed adjacent and substantially tangential to said first end of said second arcuate wall, said finger member extending into the through-hole of the bobbin element disposed in said space, the ribbon in sliding engagement with said finger member.

26. The apparatus of claim 25, wherein said finger member is a first finger member, and further comprising a second elongate finger member disposed adjacent and substantially tangential to said second end of said second arcuate wall, said second finger member extending towards said first surface portion of said first arcuate wall, the ribbon in sliding engagement with said second finger member, whereby the ribbon is directed towards said first arcuate wall.

27. The apparatus of claim 26, wherein said space is a first space in which is disposed a first bobbin element having a through-hole, said cavity further including a second space in which a second bobbin element having a through-hole is disposed, said second finger member extending into the through-hole of the second bobbin element disposed in said second space, the ribbon in sliding engagement with said second finger member.

28. The apparatus of claim 27, wherein said first and second finger members are selectively extended into and retracted from the bobbin through-holes.

29. The apparatus of claim 19, further comprising means for severing the ribbon.

30. The apparatus of claim 29, wherein said means for severing the ribbon comprises means for forming a leading edge in the ribbon.

31. The apparatus of claim 30, wherein said means for forming a leading edge in the ribbon comprises means for forming a trailing edge in the ribbon.

32. The apparatus of claim 19, further comprising means for controllably drawing said second fixture part away from said first fixture part such that said cavity is expanded from its said first size to its said second size.

33. The apparatus of claim 32, wherein said means for controllably drawing said second fixture part away from said first fixture part comprises an electric motor coupled to said second fixture part.

34. The apparatus of claim 33, wherein said electric motor is a servomotor, said second fixture part drawn away from said first fixture part as said servomotor rotates in one direction.

* * * * *